9/4/84 XP 4,469,150

United States Patent [19]

Grimaldi

[11] Patent Number: 4,469,150

[45] Date of Patent: Sep. 4, 1984

[54] DISPENSER FOR AUTOMATICALLY DISPENSING A BEVERAGE OR LIQUID FOOD INTO TAKE-AWAY RECIPIENTS

[76] Inventor: Pierre-Franç A. Grimaldi, 41, Cours Napoléon, Ajaccio - 20000, France

[21] Appl. No.: 371,267

[22] Filed: Apr. 23, 1982

[30] Foreign Application Priority Data

May 5, 1981 [FR] France ..... 81 09053
Nov. 5, 1981 [FR] France ..... 81 20896

[51] Int. Cl.[3] ..... B65B 3/04

[52] U.S. Cl. ..... 141/95; 141/98; 141/198; 141/361; 209/525; 222/30; 235/381; 250/223 B; 340/825.35; 356/387

[58] Field of Search ..... 141/94, 95, 96, 100, 141/105, 193, 198, 250, 283, 267, 351-362, 367, 373, 378, 206, 209, 218, 219, 84, 88, 98; 209/525; 356/240, 372, 387; 340/825.35; 235/381; 222/30; 250/223 B

[56] References Cited

U.S. PATENT DOCUMENTS

| | | | |
|---|---|---|---|
| 3,087,517 | 4/1963 | Magnuson et al. | 141/88 |
| 3,089,594 | 5/1963 | Early | 250/223 B |
| 3,094,154 | 6/1963 | Daniels | 141/88 |
| 3,791,291 | 2/1974 | Macune et al. | 222/30 |
| 3,887,110 | 6/1975 | Porter | 222/16 |
| 3,916,963 | 11/1975 | McIntosh | 141/198 |
| 4,319,128 | 3/1982 | Dow et al. | 222/30 |

FOREIGN PATENT DOCUMENTS

| | | |
|---|---|---|
| 2050665 | 4/1972 | Fed. Rep. of Germany . |
| 2199747 | 4/1974 | France . |

*Primary Examiner*—Houston S. Bell, Jr.

[57] ABSTRACT

A dispenser for automatically dispensing into receptacles of variable dimensions, a very accurate volume of liquid stored in bulk form in at least one tank. The dispenser has several dispensing units each having a mobile spout that can be automatically returned to a rest position, a volume measuring container placed between a filling and an emptying electrovalve. A switch opens the emptying valve when it is manoeuvered by a customer. The dispensing unit also supplies a ticket indicating the volume and/or the price of the dispensed liquid.

14 Claims, 9 Drawing Figures

42
43
10
52
58
53
55
54
56
1
51
57
62
63
44
6
11
12

46
45
51
57
62
60
63
59
61
VIII
VIII
44a 51
45
44a

DISPENSER FOR AUTOMATICALLY DISPENSING A BEVERAGE OR LIQUID FOOD INTO TAKE-AWAY RECIPIENTS

The invention relates to dispensers for automatically dispensing into take-away recipients, of variable dimensions, a beverage or liquid food which is stored in bulk in one or more tanks.

Beverages such as wine, mineral or spring water, fruit juices, edible oils, milk, etc . . . are generally sold retail, already packed in bottles or recipients. Prior packing involves packing costs, an increase in weight and volume during handling, transport and offering for sale, and costs of non-returnable packing or deposit and return of packings.

It is an object of the present invention to eliminate these additional costs by allowing the sale of beverages and liquid food stored in bulk in take-away recipients belonging to the customer, which may therefore be of variable dimensions and which the customer himself places beneath an automatic dispenser which may dispense either a determined dose, for example one liter or multiples of one liter, or a dose predetermined by the customer, or even any volume corresponding to that of the recipient, which dispensers edit a ticket which indicates the price and/or the quantity of liquid distributed and being equipped with means which measure the quantity of liquid dispensed with all the precision required for measuring apparatus which invoice the public with a price.

A further object of the invention is to provide automatic liquid food dispensers which are particularly adapted for retail sale in self-service stores where the customer presents his ticket to a cash desk, but which may be used in any retail outlet.

Dispensers for automatically dispensing liquid stored in bulk, for example gasoline dispensing pumps, are known, which continuously measure the volume of gasoline dispensed and which display the price thereof or which edit a ticket.

Gasoline pumps comprise a manual valve which is placed at the end of a flexible hose but this design is ill-suited to automatic self-service dispensing as it may be subject to vandalism.

Automatic dispensers are also known which are used in bars or restaurants to fill a glass, cup or goblet, i.e. recipients having more or less uniform dimensions.

Such dispensing apparatus are described for example in French Pat. No. 2 250 162 (R. Eggler), U.S. Pat. No. 3,145,741 (J. T. Smith et al), U.S. Pat. No. 2,757,846 (A. J. Varrin et al), U.S. Pat. No. 2,795,355 (J. Somozo).

In these known apparatus, high precision in the measurement of the dose of liquid dispensed is not required.

The aims of the invention are attained by means of automatic dispensers comprising one or more dispensing units grouped in the same cabinet, in which each unit comprises, in combination:

a spout which is connected to said tank via a valve;

a means for precisely measuring the quantity of liquid dispensed by said spout;

a sink element located beneath said spout, comprising a means for supporting the recipient;

at least one means for detecting the presence of a recipient of variable dimensions beneath said spout, which prevents the opening of said valve in the absence of recipient;

a switch manoeuvred by the customer which controls opening of said valve;

a means for supplying a ticket indicating the quantity and/or the price of liquid dispensed.

The spout preferably comprises an air intake located immediately downstream of said valve to allow rapid flow of the liquid contained between said valve and the end of the spout.

The spout is advantageously mobile and comprises means for automatically returning it towards a rest position and a microswitch actuated by said spout when said latter is in rest position.

According to a first embodiment, the spout is a rigid tube articulated about a horizontal axis and comprises a means for automatically returning it towards a low position where the end of the spout is at a height above said support means lower than the height of the smallest recipient and a microswitch having a contact which is open when said spout is in said rest position, which contact is placed in a circuit for controlling opening of said valve and prevents opening thereof if said spout has not been raised by a recipient placed therebeneath.

According to a second embodiment, the spout is a vertical tube which slides in a vertical guiding means, which comprises a means for automatically returning it towards a high rest position where the end of said spout is located at a height above said support higher than the height of the largest recipient, a handle which enables said spout to be engaged in a recipient and maintained therein and a microswitch having a contact open when said spout is in said high rest position, which contact is placed in a circuit for controlling opening of said valve and prevents opening thereof as long as said spout is in high position.

An apparatus according to the invention, adapted to be used automatically by the public, with recipients of variable dimensions belonging to the customers, must comprise means for detecting the presence of a recipient, which prevent the opening of the dispensing valve in the absence of recipient beneath the spout, in order to avoid losses of liquid due to false manoeuvres or acts of vandalism.

In the case of the spout being mobile and returned to a low or high rest position, the end of stroke switches which equip these spouts constitute a first means for detecting a recipient.

To reinforce detection of the presence of a recipient, the recipient support is placed on deformable supports and comprises a microswitch having a contact open when said support means is in high position, which contact prevents opening of said valve.

In addition, each dispensing unit advantageously comprises at least one emitter-receiver couple placed on either side of the normal position of a recipient beneath said spout, which receiver comprises a contact which is actuated when the beam coming from the emitter is interrupted by a recipient and which prevents opening of said valve as long as a recipient is not in correct position beneath said spout.

The dispensing apparatus according to the invention allow retail sale of liquid foods and beverages such as mineral or spring water, wine, soft drinks, etc . . ., in take-away recipients belonging to the customer, which may be of various shapes and capacities.

The dispensers according to the invention are designed to be used by the public, avoiding to a maximum false manoeuvres which may lead to losses of liquid or errors in invoicing. In particular, they comprise means for detecting the presence of a recipient which enable said recipient to be detected with certitude despite the varied shapes and sizes thereof, using both the height of the recipient by end of stroke contacts of a mobile spout, the weight of the recipient by a support placed on deformable supports and the width of the recipient by emitter-receiver couples whose beams are interrupted by the recipient.

The means for detecting the recipient also enable acts of vandalism to be avoided to a maximum.

The dispensing apparatus according to the invention are also designed to be adapted to the variable volume of the customer's recipient.

According to a first embodiment, they comprise a volume measuring device, i.e. a container of determined volume which complies with the requirements of precision required to dispense volumes of the order of one liter. Such an apparatus enables one or more doses to be dispensed in a recipient.

According to a second embodiment, a dispensing apparatus according to the invention is equipped with a volume sensor which may measure any volume by emitting pulses of which the number is proportional to the volume delivered, the precision then being equal to the elementary volume represented by a pulse which may be small enough to comply with the necessary precision requirements. This second embodiment enables the client to choose, without restriction, the quantity which he desires and which may be less than the capacity of the recipient. However, to avoid risks of overflow, this type of dispenser comprises a level sensor which automatically closes the dispensing valve when the recipient is almost full.

The invention will be more readily understood on reading the following description with reference to the accompany drawings in which.

Figure 1:
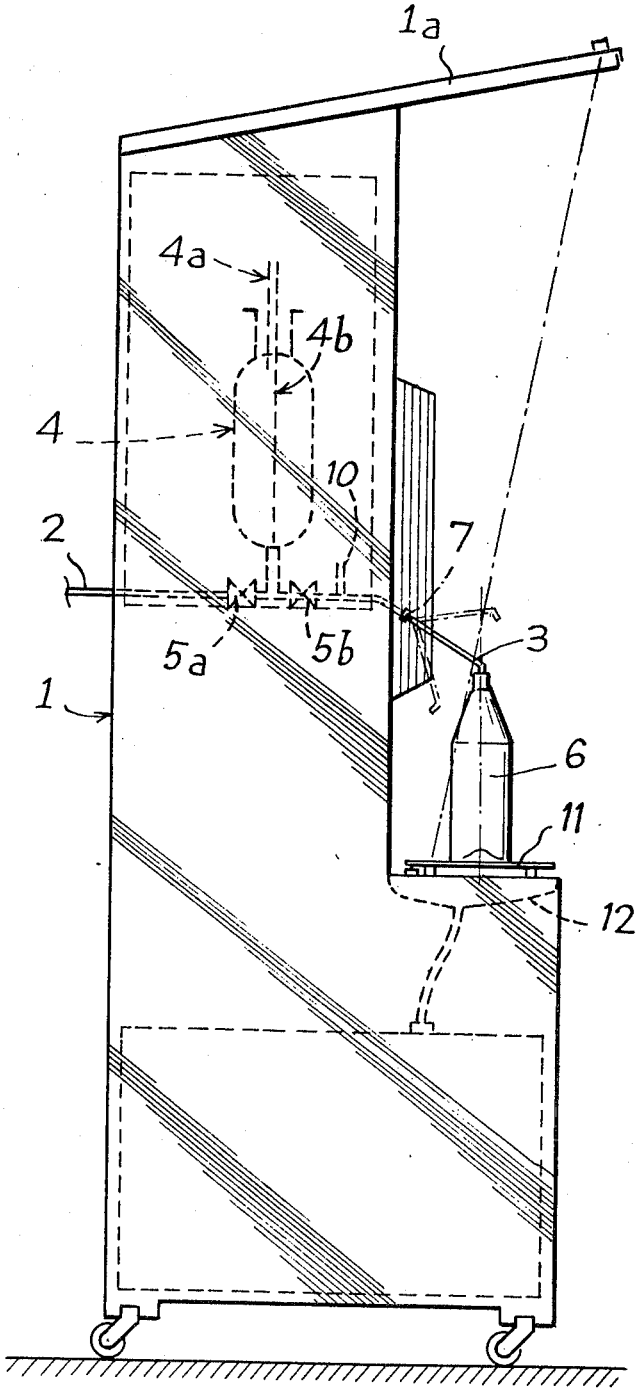
FIGS. 1 and 2 are a view in side elevation and a front view of a cabinet grouping two dispensing units.
Figure 2:
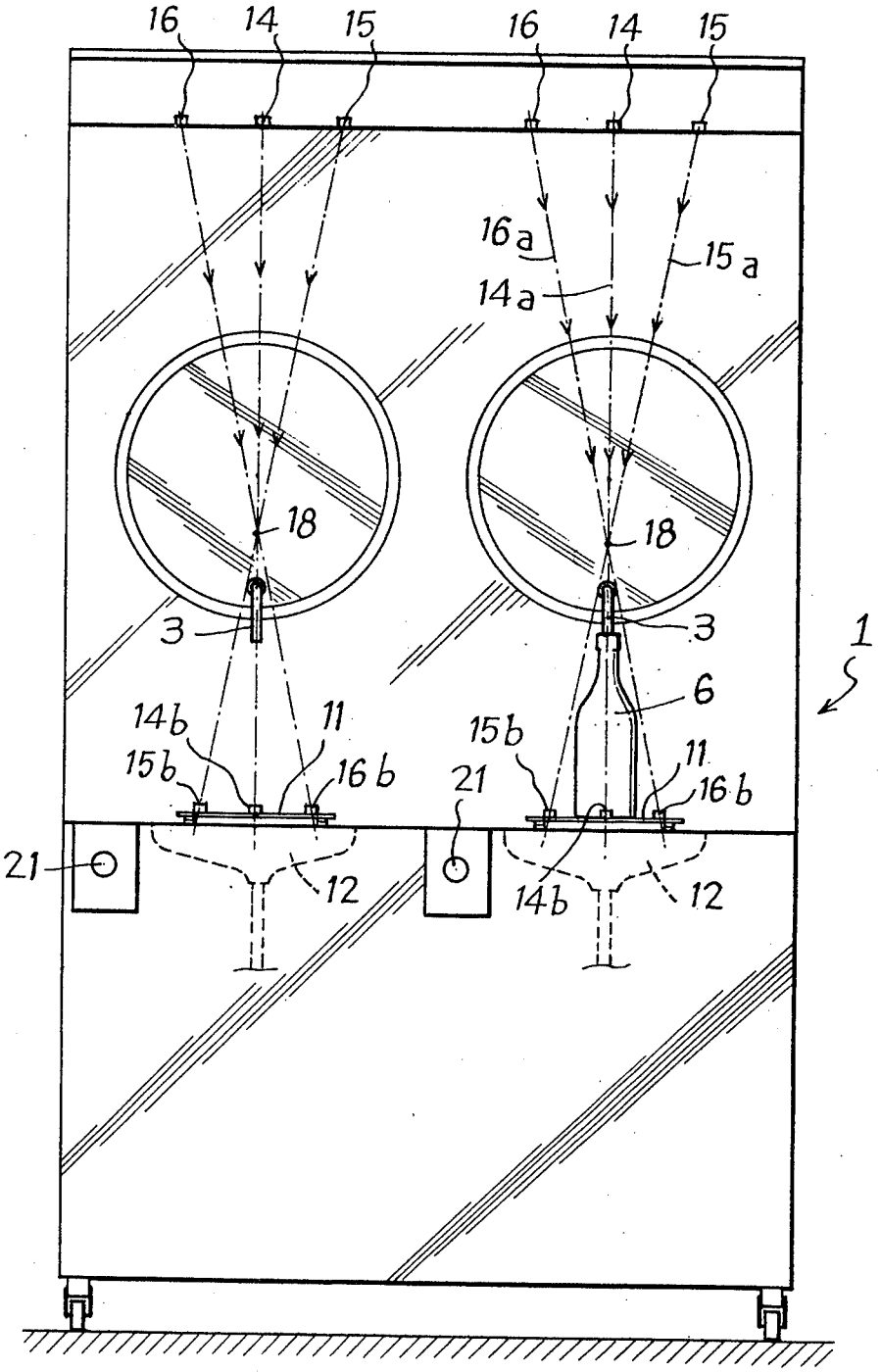

Referring now to the drawings, FIGS. 1 and 2 show an apparatus for automatically dispensing liquid, for example a wine dispenser. This apparatus comprises a cabinet 1 containing one or more dispensing units, for example two units in the case of the Figure. Each unit comprises a spout 3 which is connected to a tank or vat (not shown) containing liquid in bulk. The tank may be located above the cabinet or outside the cabinet to which it is connected by a pipe 2. Each unit comprises a means for precisely measuring the quantity of liquid which is dispensed by each spout, this means being located between the pipe 2 and the spout.

The precision of measurement must be sufficient to comply with the requirements imposed on apparatus for measuring volumes with a view to invoicing the public.

FIGS. 1 and 2 show a preferred first embodiment of an apparatus adapted to deliver predetermined or predeterminable volumes of liquid which are equal to a determined dose or to a multiple of this dose. In this case, the measuring means is a volume measuring device 4, i.e. a container of determined volume which is connected to the pipe 2 in shunt between two valves 5*a*, 5*b* and which comprises two low level and high level sensors 4*b* and 4*a* respectively. These measuring devices are known and are available on the market.

The valves 5*a*, 5*b* are for example electrovalves or any other equivalent motorised valve, for example a pneumatic or hydraulic valve.

When the valve 5*a* is open and the valve 5*b* closed, the measuring device 4 fills up, up to the level of the sensor 4*a*. When the valve 5*b* is opened and the valve 5*a* closed, the liquid contained in the measuring device flows until the level of the liquid reaches the low level determined by the sensor 4*b*. By construction, the volume of liquid between the high and low levels is equal to a volume determined with high precision, for example to a volume of one liter or of five liters. The capacities of the measuring devices may vary from one unit to the other.

Such a volume measuring device requires a filling and and emptying time which are for example 15 seconds each and the electronic circuits which control the openings and closures of the valves 5*a*, 5*b* and which will be described hereinafter, are synchronised to respect, between two successive manoeuvres of the valves, a minimum duration equal to the filling or emptying time.

To increase the possible rhythm, the dispenser may comprise two measuring tanks 4, one of which is being filled whilst the other is being emptied.

An apparatus according to the invention is intended to dispense a dose of liquid into a take-away recipient 6 which belongs to the customer and which may have very varied dimensions depending on whether they are bottles of various shapes, demi-johns, containers, etc . . . .

According to a feature of the invention, the spout 3, 3*a* is mobile to adapt itself to the shape of the recipient and, in the absence of recipient, it is automatically returned to a rest position.

Figure 3:
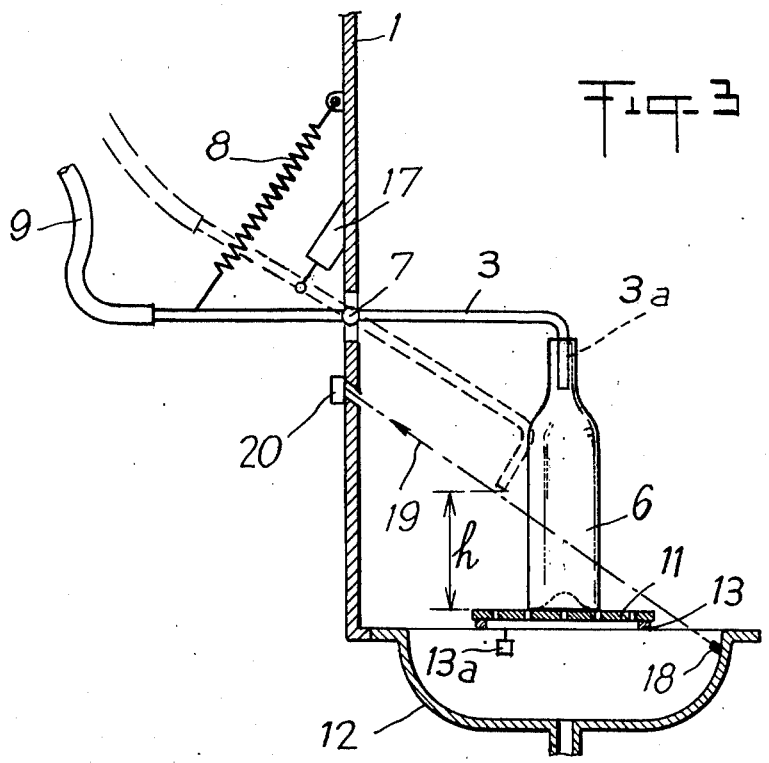
FIG. 3 is a partial section of an articulated spout and of the recipient support of a dispensing unit.

FIGS. 1 and 3 show a first embodiment of a spout which is a rigid tube 3 provided with a bent end 3*a*. The tube 3 is articulated about a horizontal axis 7 and it is connected to the outlet of the valve 5*b* by a flexible tube 9. An air intake 10, visible in FIG. 1, is located immediately downstream of the valve 5*b* to allow rapid flow of the liquid contained between the valve 5*b* and the end of the spout after closure of the valve 5*b*.

In the absence of recipient 6, a spring 8 returns the spout 3 towards a low rest position shown in broken lines in FIG. 3 where the end of the spout 3*a* is located at a height h above the support 11 lower than the height of the smallest container 6, so that it is necessary to raise the spout to engage a recipient therebeneath.

Each unit comprises a sink element 12 which is located beneath the spout to collect any accidental flow of liquid. The sink 12 comprises a means 11 for supporting the recipient 6 which is for example an openwork, perforated or slotted tray or any other equivalent support means.

The dispensers according to the invention are particularly intended to be placed in self-service stores and they must comprise safety devices preventing losses of liquid by false manoeuvres or by acts of vandalism, in particular safety devices which detect the presence of a recipient 6 and which prevent opening of the emptying valve 5b in the absence of a recipient correctly positioned beneath the spout.

FIG. 3 shows a first detection device which is constituted by a microswitch 17 which is actuated by the spout 3 when the latter is in low rest position and which has an open contact in this position. This contact is placed in a circuit for controlling opening of the valve 5b and it prevents opening thereof as long as the spout has not been raised by a recipient placed beneath the spout.

However, it is possible to raise the spout by hand without placing a recipient beneath the spout.

To reinforce safety, the apparatus described comprises another means for detecting a recipient, which is constituted by a support 11 placed on deformable supports 13 which are deformed by the weight of the recipient.

The support 11 cooperates with a microswitch 13a having a contact open when the support is in high rest position. This contact is placed in the circuit controlling the emptying valve 5b and it prevents opening thereof as long as no recipient is placed on the support 11.

FIGS. 1 and 2 show another means for detecting a recipient 6 beneath the spout. This means is constituted by emitter-receiver couples, for example photoelectric couples employing visible or preferably infrared light or ultrasounds to avoid acts of vandalism.

These couples comprise for example for each unit, three emitters 14, 15, 16 located on a hood 1a which overhangs the spouts and which emit three beams 14a, 15a, 16b which intersect at a point 18 located slightly above the spout, so that the three beams are interrupted by a recipient normally positioned beneath the spout, whatever the shape or size of said recipient.

Each receiver 14b, 15b, 16b comprises a contact which is closed when the corresponding beam is interrupted by a recipient and these contacts are incorporated in the control of the emptying electrovalve 5b and prevent opening thereof if none of the beams is interrupted.

FIG. 3 shows another embodiment of a detector which comprises one emitter-receiver couple 18, 19, 20, located in the vertical plane perpendicular to the axis 7 which is covered by the spout 3 when it pivots about axis 7. The beam 19 passes slightly below the end of the spout 3a when it is in low rest position. This arrangement enables the presence of a recipient 6 to be reliably detected with one emitter-receiver couple.

The apparatus according to FIGS. 1 and 2 comprises, for each unit, a switch for example a push button which is manoeuvred by the customer to control a dispensing cycle after having placed a recipient beneath the spout.

The apparatus according to FIGS. 1 to 3 comprises a plurality of variant embodiments which correspond to different modes of functioning.

According to a first variant, the apparatus automatically delivers a determined dose which corresponds to the volume of the measuring device 4 each time the customer presses on the button 21.

If the customer's recipient has a volume equal to several doses, the customer may press on the button 21 several times. At the end of the cycle, the apparatus delivers one ticket which indicates the total volume delivered and/or the price of this total volume.

According to a second variant, the apparatus is preprogrammable by the customer or by the store keeper. It comprises programming means enabling the number of desired doses to be recorded, this number corresponding to the number of times that the button 21 is pressed. After which the apparatus automatically effects all operations and it delivers one ticket indicating the total volume delivered and/or the total price to be paid.

Figure 4:
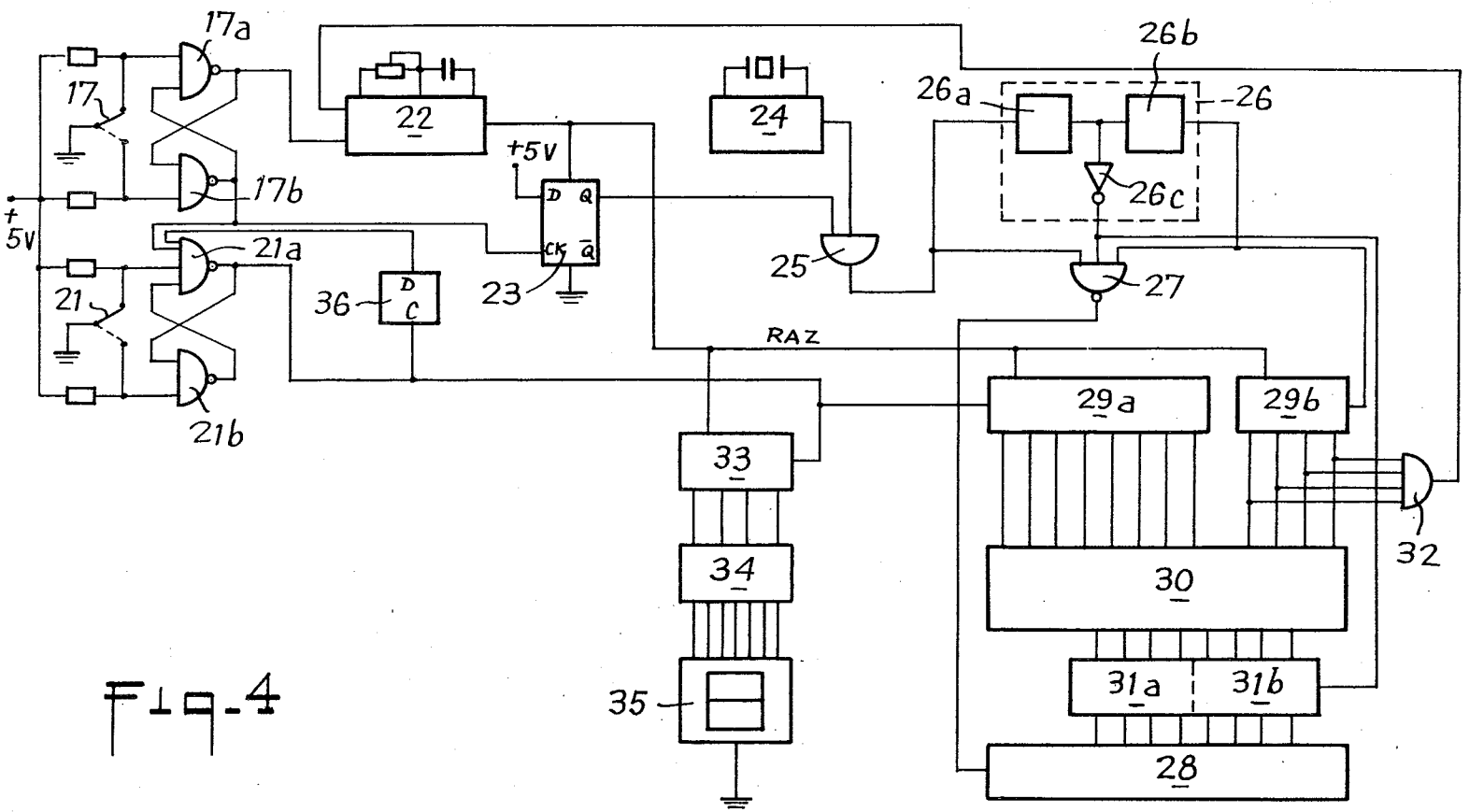
FIG. 4 is a diagram of a first embodiment of the electronic circuits of a dispenser equipped with a volume mesuring device.

FIG. 4 is a general diagram of a first embodiment of the electronic circuits equipping a unit of an apparatus according to the invention. This Figure shows the switch 21 and a contact of the microswitch 17 equipping the spout.

The switch 17 is associated with a flip flop composed of two "NOT AND" gates 17a, 17b whose outputs are crossed on the inputs. Similarly, the switch 21 is associated with a flip flop composed of two "NOT AND" gates 21a, 21b.

Reference 12 represents a monostable element. Reference 23 represents a flip flop. Reference 24 represents a clock which oscillates for example at a frequency of 1 MHz. Reference 25 represents a clock validation AND gate. Reference 26 represents printer timing circuits which are composed of two frequency dividers 26a, 26b which each divide the pulses by two and of an inverter circuit 26c. The circuits 26 are intended to obtain a correct rhythm for the printer.

Reference 27 represents a summation circuit adapted to produce the signal controlling the printer 28.

References 29a, 29b represent two binary counters. Reference 30 represents a memory which is for example a programmable memory (PROM) which may contain a plurality of messages each having 16 octets, each message indicating the number of doses distributed and/or the total price thereof.

The binary counter 29a serves as address counter of the bit of highest weight of each message and makes it possible to seek in the memory the beginning of the message corresponding to the total number of doses dispensed.

References 31a, 31b represent two levels of a three-level memory (74 367 circuits) adapted to isolate the outputs towards the printer.

Reference 32 is an AND gate with four inputs which are connected to the four outputs of the counter 29b which determines the addresses of each character of a message.

Reference 33 is a pulse counter. Reference 35 is a B.C.D. decoder with seven segments which controls a light display 35 employing electroluminescent diodes, which displays as decimal the number of doses dispensed. It is assumed that the number of doses which may be totalled is limited for example to nine and the memory 30 therefore contains nine messages.

Reference 36 represents the measuring device 4 or electronic circuits forming an integral with the measuring device 4. The terminal D is at logic level "1", when the measuring device is available. It is at logic level "0" when the measuring device is being emptied or filled. The terminal D is connected to an input of the gate 21a and inhibits the flip flop 21a, 21b when the measuring device is being emptied or filled. The terminal C represents the control of the valves 5a, 5b of the measuring device which is effected by the pulses emitted by the output 21a of the flip flop 21a, 21b. The rising fronts of the pulses control emptying of the measuring device 4.

Operation is as follows:

It is the return of the spout into rest position which triggers off printing of a ticket indicating the total quantity delivered and/or the total price to be paid. The customer places his recipient on the support 11. On doing so, this trips the switch 17 which produces a falling front at the output of 17*a* and therefore a rising front at the output of 17*b*. The falling front at the output of 17*a* trips the monostable element 22. The output of the monostable element returns to zero the flip flop 23 and the address counters 29*a*, 29*b* and 33, if the latter have not been returned to zero at the end of the preceding cycle.

The circuits are ready for a new cycle.

The negative pulse at the output of 17*b* is sent on an input of the gate 21*a* and allows control of the measuring device.

When the customer presses on the push button 21, on condition that the other detectors detecting the presence of the recipient (not shown in the diagram) allow dispensing, the output 21*a* emits a rising front which controls opening of the emptying valve 5*b*.

A dose is dispensed. When dispensing of the dose is terminated, the sensor 4*b* of the measuring device automatically controls closure of the valve 5*b* and opening of valve 5*a* to fill the measuring device 4 again. During this time, the output D of the circuit 36 prevents the passage of a new order through the gate 21*a*.

Each order of opening of the valve 5*b* leaving the gate 21*a* is transmitted to the counter 33 which records it and it is displayed on the indicator 35. Similarly, each order is recorded by the address counter 29*a*.

When a cycle of emptying and filling of the measuring device 4 is terminated, the customer may, without touching the recipient 6, press on the button 21 again to obtain a second dose added to the first, and so on.

When the customer decides that his recipient is sufficiently full, he removes it and the spout 3 returns to the rest position. The contact 17 trips, which produces a falling front at the output of 17*b* which trips the flip flop 23 whose output Q passes to level 1, which opens the gate 25 and allows the message contained in memory 30 to be printed. The address of the beginning of the message to be printed is given by the counter 29*a* which counted the number of doses delivered.

The printer functions as follows: Upon the first clock pulse 24, the first character located at the address of the memory indicated by the counter 29*a* is selected.

The output of the divider 26*a* is inverted by 26*c* and is applied on the validation inputs of the two circuits 31*a*, 31*b*, which allows passage towards the printer 28 of the first character of the message taken in the memory. The adder circuit 27 makes the sum of the signal leaving the gate 25, the output of the inverter 26*c* and the output of the divider 26*b*, and delivers a signal which serves as signal controlling the printer.

The embodiment described comprises a memory and a printer.

As a variant, it may comprise a dispenser of preprinted tickets each bearing a number of doses and/or the price thereof and a ticket selector which would be controlled by the counter 19*a* and a decoder with nine positions and which would deliver a ticket totalling the number of doses recorded by this counter when the switch 17 trips.

Figure 5:
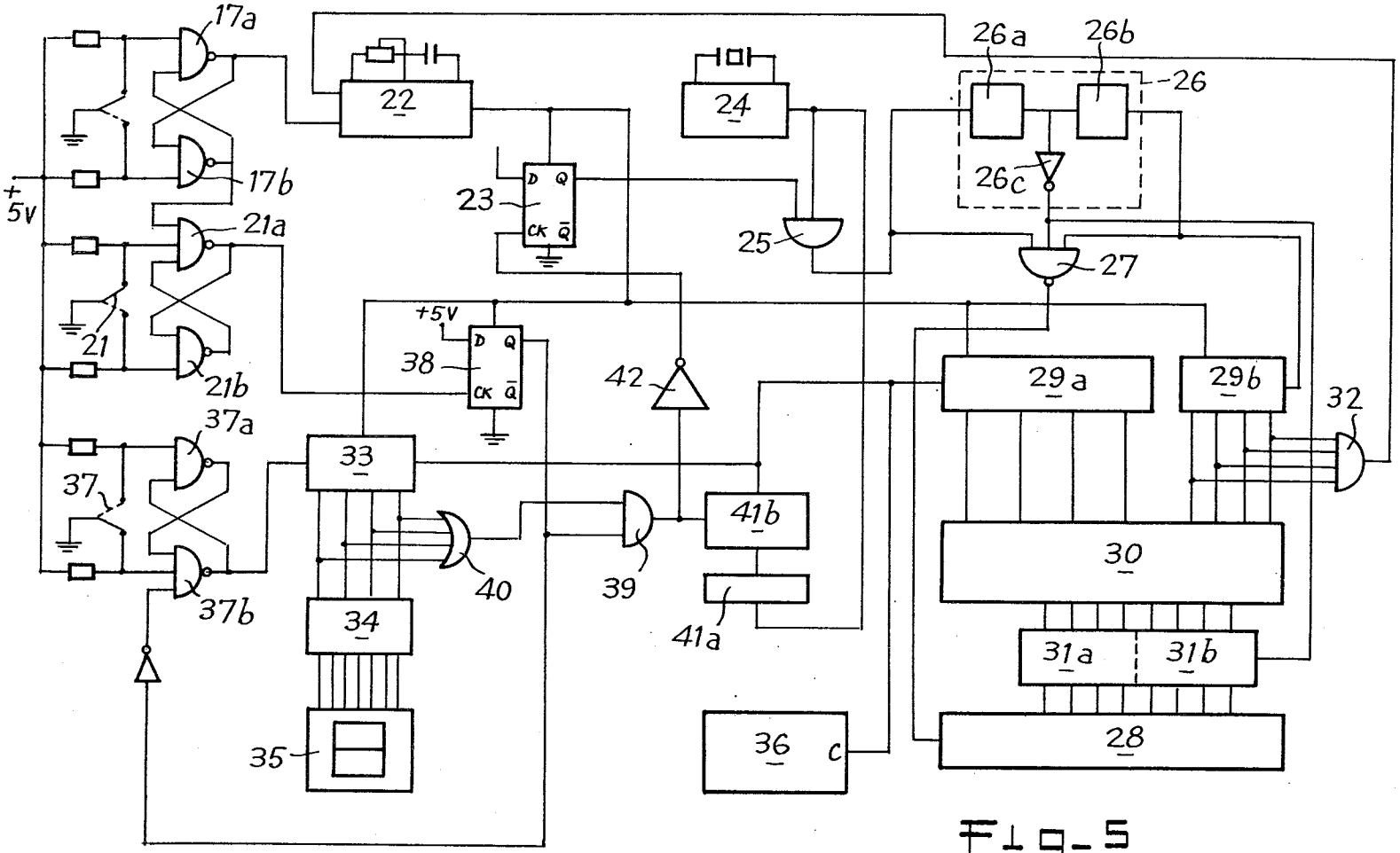
FIG. 5 is a diagram of asecond embodiment of the electronic circuits of a dispenser equipped with a volume measuring device and a programming means.

FIG. 5 is a general diagram of a second embodiment of the electronic circuits of an apparatus according to FIGS. 1 to 3 preprogrammable by the customer or by the store keeper.

Part of the diagram is the same as that of FIG. 4 and like components are represented by like references and perform the same functions.

The apparatus according to FIG. 5 comprises a programming push button 37 which is associated with a flip flop composed of two "NOT AND" gates 37*a* and 37*b*. The customer presses on the button 37 a number of successive times equal to the whole number of doses which he desires. Each act of pressing on the button 37 creates at the output of 37*b* a pulse which is recorded by the counter 33 which is an upcounter-downcounter and the total number of doses is displayed on the light display 35.

In this example, the display comprises one decimal display module and the maximum number of doses is equal to nine.

The fact of a customer pressing on the button 21 trips a flip flop 38 whose output Q passes to level 1. This output is connected to an input of an AND gate 39 whose second input is connected to the output of an OR gate 40 having four inputs connected to the four outputs of the counter 33. When the flip flop 38 trips, the AND gate 39 therefore allows the pulse to pass if the counter 33 is not at zero, i.e. if at least one dose has been preprogrammed.

References 41*a*, 41*b* represent a timer which is a multi-level frequency divider, whose input is connected to the clock 24 and whose function is to divide the clock frequency to obtain a lower frequency compatible with the times for filling and emptying the measuring device 4. If for example the emptying time and the filling time are each equal to 15 seconds, the frequency at the output of the divider 41*b* is 1/30 Hz.

When the output of the gate 39 passes to level 1 due to the pressure exerted on the button 21, it deblocks the divider 41*b* which begins to emit pulses.

The output of the divider 41*b* is connected on the measuring device 36.

The divider 41*b* emits, every thirty seconds, a rising front which controls the emptying of the measuring device 4 and a falling front every thirty seconds which controls filling of the measuring device 4.

The output of the divider 41*b* is connected to a cut-off terminal of the counter 33. Each falling front emitted by the divider 41*b* decreases by a unit the number recorded in the counter 33. When the counter 33 has arrived at zero, the programmed number of doses has been dispensed.

The passage to zero of the counter 33 blocks the AND gate 39. The output of the gate 39 is connected to an inverter 42 whose output is connected to an input terminal of the flip flop 23.

The change of state of the output of the gate 29, inverted by 42, trips the flip flop 23 whose output Q passes to level 1 and deblocks the gate 25 which allows a ticket to be printed, indicating the total quantity dispensed and/or the price thereof.

The output of the divider 41*b* is also connected to the input of the address counter 29*a* and when the counter 33 has returned to zero, the number of doses originally programmed and dispensed is recorded in the counter 29*a* and gives the address of the first character of each message inscribed in the memory 30 which has a minimum capacity of $9 \times 16 = 144$ octets, each message comprising 16 octets each indicating a whole number of dispensed doses and/or the price thereof.

The printing circuits are the same as those of FIG. 4 and printing of the ticket takes place according to the same process.

At the end of printing of a message, the four outputs of the counter 29*b* are at level one. The gate 32 opens.

The output of this gate is connected to the input of the monostable element 22 and the latter trips when the gate 32 opens.

The output of the monostable element 22 returns to zero the flip flops 23 and 38 and the counters 33, 29*a* and 29*b*.

If by accident the return to zero were not controlled by the end of printing, it would be at the beginning of the following cycle by the opening of the contact 17 when the customer engages a recipient beneath the spout 3 and raises said spout.

FIGS. 1 to 5 describe an embodiment of a dispenser equipped with a measuring container 4. It is specified that this measuring container may be replaced by any other measuring device capable of dispensing one or more determined doses or doses determinable for example by a volume sensor employing pulses which is associated with a pulse counter itself associated with a comparator which stops dispensing when a predetermined number of pulses is attained.

According to a second variant embodiment, the means used for measuring the quantity of liquid distributed is a continuous volume sensor which delivers an analog electric signal or a number of pulses which is proportional at any instant to the total volume which has passed through the sensor from a dispensing.

Such a sensor may be constituted for example by a turbine counter which is rotated by the liquid and emits pulses, each pulse representing a sufficiently small elementary volume, for example of the order of one centiliter, for the measurement to comply with the requirements of precision imposed for an apparatus intended for invoicing a price to the public.

This solution presents the advantage that the quantity of liquid dispensed to a customer may be freely chosen by said customer without it being necessary for it to be equal to a whole multiple of a dose.

Figure 6:
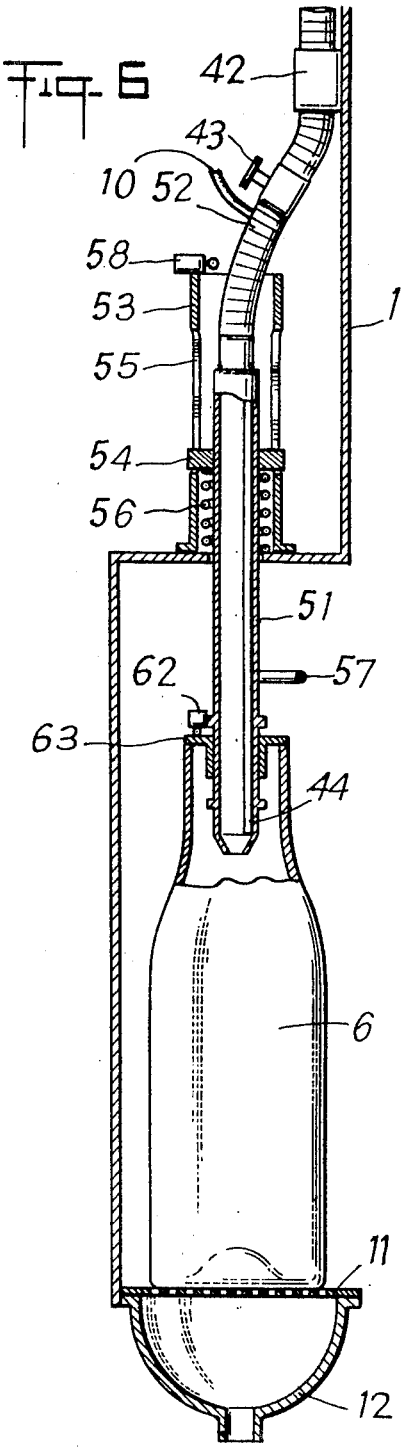
FIGS. 6, 7 and 8 are views of a sliding spout of a dispenser equipped with a volume sensor and a level sensor.

FIG. 6 shows a second embodiment of a mobile spout which slides vertically.

The Figure corresponds to an apparatus equipped with a continuous volume sensor 42 which is placed near the spout upstream of a valve 43, which is for example an electrovalve.

It is specified that a sliding spout may also be used in dispensers equipped with volume measuring devices and that pivoting spouts according to FIG. 3 may be used in dispensers equipped with a continuous volume sensor and, in this case, they are provided with a level sensor as described hereinafter.

Figure 7:
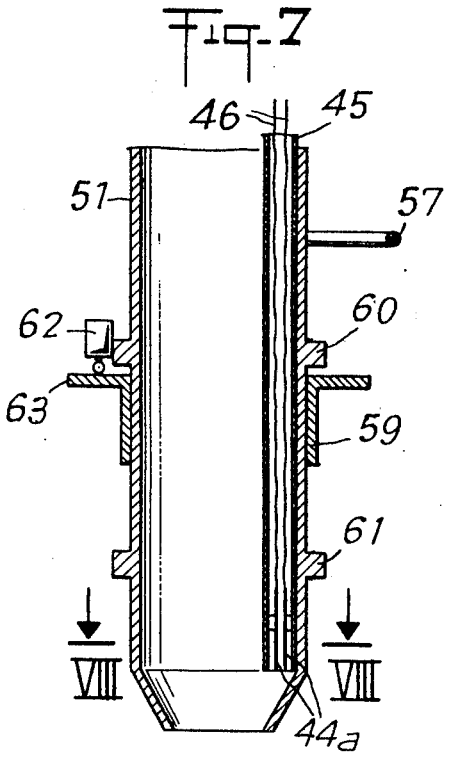
Figure 8:
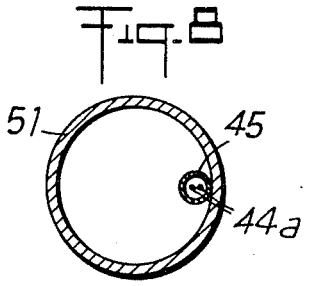

FIG. 6 shows a partial vertical section through a sliding spout. FIG. 7 is an axial section, to a larger scale, of the end of the spout. FIG. 8 is a transverse section along VIII—VIII of FIG. 7.

In this embodiment, the spout may move vertically to adapt itself to the variable height of the customers' recipients.

The spout according to FIGS. 6, 7 and 8 comprises a rigid inner tube 51 which is connected by a flexible pipe 52 to a tank for storing the liquid in bulk (not shown), through an electrovalve 43 and a continuous volume sensor 42.

The electrovalve 43 is placed as closely as possible to the end of the spout in order to reduce the volume of the pipe located downstream of the electrovalve. The spout comprises an air intake 10 located immediately downstream of the electrovalve.

The tube 51 contains a small tube 45 in which is placed a level sensor 44 which is constituted for example by two electrodes 44*a* connected by wires 46 to electronic circuits.

As a variant, the tube 45 may be placed outside the tube 51. The tube 45 is open at its two ends. The lower end of the tube 45 is located near the open end of the tube 51 and the ends of the two electrodes are located near the lower end of the tube 45.

As soon as the level of the liquid reaches the electrodes 44*a*, an electric current is established and the signal is detected and used by the electronic circuits which automatically control closure of the electrovalve 43.

As a variant, the level sensor may comprise one electrode only, the second being replaced by the tube 45 which is conducting.

The level sensor with electrodes is a preferred embodiment of a sensor of small dimensions which may be placed very near the end of the spout. This sensor may be replaced by other equivalent level sensors.

The tube 51 slides vertically in a guiding means, for example in an outer tube 53 of greater diameter. The tube 51 comprises fins 54 which are engaged in vertical windows 55 cut out in the tube 53. The fins 54 prevent the tube 51 from rotating on its axis and the ends of the slots 55 serve as top and bottom stops which limit the stroke of the inner tube. The height of the slots 55 is slightly greater than the difference in height between the tallest and smallest of the recipients 6 which may be used.

Of course, the tube 53 may be replaced by any other guiding means, for example by vertical rods.

A spring 56 is placed in the space between the inner tube and the outer tube.

A handle 57, fixed to the outer tube, enables it to be maintained manually in low position where the end of the tube is engaged in the neck of a recipient 6, as shown in FIG. 1.

When the handle is released, the spring 56 returns the inner tube towards its rest position which is the high position. Of course, the spring 56 may be replaced by equivalent means, for example the tube 51 may be suspended from a spring which is drawn when the tube 51 is lowered. It may be suspended from a counterweight.

As a variant, the flexible pipe 52 may be wound on a springloaded winding drum which tends to rewind it when it is unwound and which returns the tube 51 towards the high rest position.

An end of stroke switch 58 detects the high rest position of the inner tube 51. This switch performs certain functions of the switch 17 of FIG. 3. It prevents opening of the electrovalve 43 at the beginning of a cycle. It also controls the printer and the return to zero of the counting unit when printing is finished, if it is actuated in the course of a cycle before the level sensor 44.

The lower end of the tube 51 comprises a detector detecting the presence of the recipient 6, which is shown to a larger scale in FIG. 7. This detector comprises a ring 59 which slides outside the tube 51 between two stop flanges or rings 60 and 61. The upper flange 60 carries a microswitch 62 whose contact is closed by the sliding ring when the latter is in high position.

The ring 59 comprises a flange 63 or radial arms whose outer diameter corresponds to that of the widest necks, which abuts on the upper edge of the neck of the recipient 6 when the spout is lowered inside the recipient, this leading to pushing the ring upwards and closing a contact of the switch 62. This contact is incorporated in the chain of contacts for detecting the presence of the recipient 6 which are mounted in series and which prevent opening of the electrovalve 43 as long as one of them is open.

The contact of the switch 62 obliges the customer to maintain the spout 51 engaged in the neck of the recipient for the whole of the filling operation and it therefore determines with precision the position of the level sensor 44 with respect to the upper edge of the neck of the recipient.

If the customer stops pulling on the handle 57, the contact 62 opens and it controls closure of the electrovalve 43 and stopping of dispensing.

The switch 62 associated with the sliding ring 59 is a very sure means of detecting the presence of the spout in the neck. This results in that, in this embodiment, the contact of the switch 62 may be used to replace the manual button for controlling the beginning of a cycle.

The same detection device employing sliding ring may be used on the spout 3 articulated about a horizontal axis shown in FIG. 3. However, in the case of the bent end 3*a* of the spout engaging obliquely in a neck, the sliding ring may not function reliably. This is why, in the case of an articulated spout 3, it is provided to prefer using an optical detector for detecting the presence of the recipient 6 beneath the spout.

FIG. 3 shows an embodiment of such a detector which comprises a light source 18 located in the vertical plane perpendicular to the axis 7 which is covered by the spout in its pivoting movement.

The light source 18 is located for example slightly below the front edge of the sink element 12 and it emits an oblique light ray 19 which passes slightly beneath the free end of the spout in rest position and which is received by a photoelectric detector 20 located on the vertical wall of the cabinet 1 or behind a hole in said wall. The detector 20 receives the light ray 19 if the latter is not intercepted by a recipient 6. The light source and the photoelectric detector may obviously be reversed, or be placed side by side with a mirror placed at the other end of the light path. This position in the vertical plane covered by the spout makes it possible to use only one light beam which is interrupted by a recipient 6 which inevitably intersects this vertical plane if it is placed beneath the spout, but which also intersects it even if it is not placed exactly beneath the spout.

In this embodiment, the openwork tray 11 comprises a slot or gap located at the intersection of the tray and the vertical plane covered by the spout. This gap allows the drops of liquid to drop into the sink element without leaving any trace on the tray, which consequently remains cleaner. It also allows free passage of the light ray and it therefore enables the light source or the photoelectric receiver to be placed beneath the plane of the tray where they are better protected.

In the case of the level sensor 44 being constituted by two electrodes placed in a tube 45 which is open at the upper end, it is advantageous to connect the tube 45 on the back flow of a small fan which automatically blows air into the tube 45 when the spout is in rest position in order to dry the electrodes and to avoid risks of parasitic conduction by drops of liquid establishing an electrical contact between the two electrodes 44*a* or between one of them and the ground of the tube 45.

Figure 9:
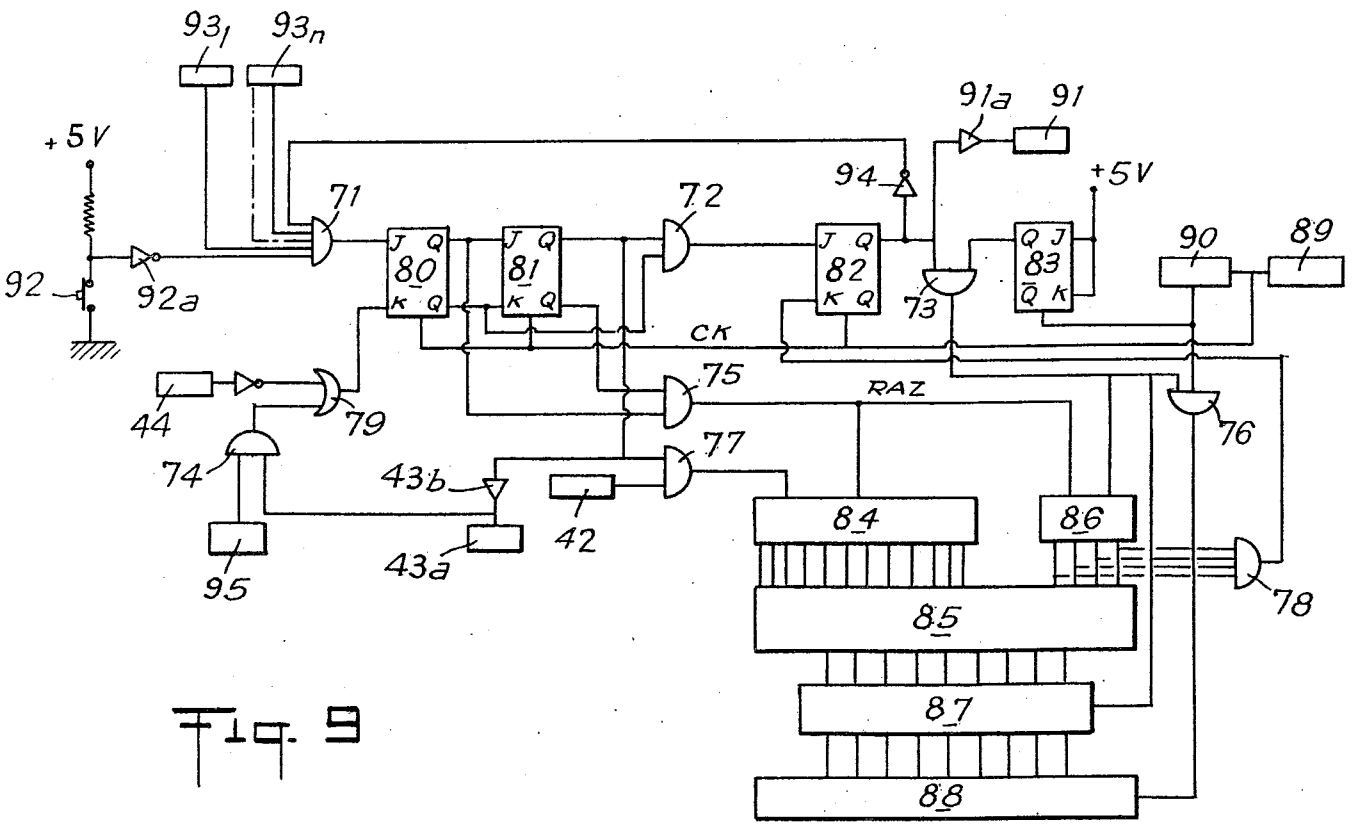
FIG. 9 is a diagram of the electronic circuits of a dispenser equipped with a continuous volume sensor.

FIG. 9 is an overall diagram of an embodiment of the electronic circuits which constitute the logic unit of a dispensing apparatus comprising a continuous volume sensor.

References 71 to 78 represent logic AND gates. Reference 79 represents a logic OR gate. References 80, 81, 82, 83 are flip flops of JK type.

The flip flops of JK type comprise two logic inputs J and K and two logic outputs Q and $\overline{Q}$, a clock input CK and a return to zero terminal RAZ.

Functioning of these flip flops is summarized in the truth table hereinafter:

| J | K | CK | Q | Q |
|---|---|---|---|---|
| 0 | 0 | 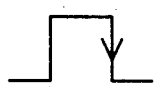 | $Qn = Qn - 1$ | $\overline{Qn} = \overline{Qn} - 1$ |
| 0 | 1 | 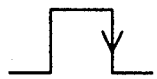 | $Qn = 0$ | $\overline{Qn} = 1$ |
| 1 | 0 | 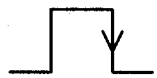 | $Qn = 1$ | $\overline{Qn} = 0$ |
| 1 | 1 | 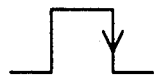 | $Qn = \overline{Qn} - 1$ | $\overline{Qn} = Qn - 1$ |

The outputs of the flip flop change polarity after the falling front of a clock pulse.

The truth table shows that if J=K=1, the flip flop acts as divider by two of the clock pulses.

Table 8 shows two flip flops 80, 81 associated with two AND gates 72 and 75 with two inputs. The two inputs of the gate 72 are respectively connected to the output $\overline{Q}$ of the flip flop 80 and on the output Q of the flip flop 81. The two inputs of the gate 75 are respectively connected to the output Q of the flip flop 80 and on the output $\overline{Q}$ of the flip flop 81. It is known that such an assembly makes it possible to obtain square waves of determined duration equal to the period of the clock whatever the duration of the pulses received on the inputs J and K of the first flip flop. This assembly replaces the monostable elements to emit a square wave of determined duration.

If for example the inputs J and K of the two flip flops are at zero and the input J of flip flop 80 is taken to polarity 1 for any duration, at the first falling front of the clock, Q80 and J81 pass to value 1 whilst $\overline{Q}$80 and K81 take value 0.

At the second falling front of the clock, the outputs Q80 and $\overline{Q}$80 do not change. The output Q81 takes the value 1 and the output $\overline{Q}$81 takes value 0.

A square wave is therefore obtained at the output of the gate 75, which begins with a first falling front of the clock signal and which terminates with the following falling front, i.e. a signal whose duration is equal to the period of the clock.

FIG. 9 shows the electromagnet 43*a* which controls the electrovalve 43 and which is energized through an amplifier 43*b* adapted to amplify the logic signals which control the electromagnet.

This Figure also shows the volume sensor or flow meter 42 which emits pulses, each of which represents a unit of volume. The element 42 emits for example 300 pulses per liter, so that each pulse represents a unitary volume equal to 3.33 ml. It is assumed that the dispensing apparatus is provided to supply recipients whose maximum capacity is 5 liters, which therefore corresponds to 1500 pulses.

Reference 84 is a pulse counter comprising 12 binary outputs.

Reference 85 is a memory having a capacity of 24K octets which contains 500 messages and 16 octets each. Each of the messages indicates one of the 1500 volumes and the price thereof.

The messages are stored in the memories 85, so that the address of the first octet of each message corresponding to one of the 1500 volumes is expressed by the binary number emitted on the outputs of the counter 84 when the counter has recorded the number of pulses indicating the volume dispensed.

In other words, the binary outputs of the counter 84 serve as address for the first octet of each message recorded in the memory 85.

Each octet of the memory 85 is marked by 16 address wires of which the 12 of highest weight correspond to the 12 outputs of the counter 84 and of which the 4 of lowest weight correspond to the 4 outputs of a second binary counter 86. The counters 84 and 86 constitute the address counter of the memory 85.

Reference 87 represents a buffer having a capacity of 1 octet in which are successively transferred the 16 octets of the message whose address was selected at the end of dispensing. Reference 88 represents a printer which prints the message contained in the buffer.

In the example shown, the prices to pay, corresponding to all the possible multiples of the unitary volume, i.e. to all the multiples of 3.33 ml, are therefore calculated in advance and recorded in memory 85, this enabling dispensing apparatus to be constructed which comprise only simple logic components without any computing unit. When the unitary prices are modified, the memory 85 is changed or the contents thereof are cancelled and new messages corresponding to the new unitary prices are recorded.

As a variant, a computer unit may be used which would make each time the product of the number of units of volume counted by the counter 84 by the price of the unit of volume contained in a memory.

Reference 89 represents the synchronisation clock which is for example an oscillator having a frequency of 1 MHz. Reference 90 represents a frequency divider which divides for example by 50,000 the frequency of the clock and which therefore emits on 20 Hz. Reference 91 represents the motor of the small fan which is connected to the top end of the tube 45 containing the electrodes of the level sensor 44 to dry said electrodes. Reference **91*a*** is an amplifier which amplifies the fan control signal.

The inputs of the signals, outside the pulses coming from the sensor 42, arrive on the two terminals J and K of the flip flop 80.

References 92 and **92*a* represent a push button which serves manually to control the beginning of a dispensing operation. As a variant, the manually controlled push button 92 may be replaced by a contact, for example by a contact of the switch 62 in the case of the spout of FIGS. 6 and 7**.

The output of the push button 92 is connected to an input of the gate 51 and sends a logic signal 1 on this input when the contact is formed.

In the case of the Figure, the push button 92 annuls the voltage 5 V at the input of an inverter **92*a*** so that the output of the inverter passes to level 1.

The other inputs of the gate 71 are connected to safety contacts $93_1 \ldots 93_n$ which are contacts of the detectors detecting the presence of the recipient beneath the spout.

In the case of a pivoting spout as shown in FIGS. 1, 2 and 3, the contacts $93_1 \ldots 93_n$ are in particular the contacts of the receivers **14*b*, 15*b*, 16*b* or of the receiver 20 of FIG. 3**.

If the light beam is not interrupted, the photoelectric receivers emit a signal 0.

Another detector is a contact of the switch 17 which emits a signal 0 if the spout is in rest position. Another safety contact may be a contact of the switch **13*a* actuated by the tray 11** which emits a signal 0 as long as no recipient is placed on the tray.

In the case of the sliding tray according to FIGS. 6 and 7, one of the contacts 93 is a contact of the switch 62 which emits a signal 0 as long as the ring 59 is not in abutment against the switch. In this case, the signal emitted by the sliding ring 59 indicates, very reliably, the presence of a recipient and one safety contact only may suffice.

An input of the gate 71 is connected through an inverter 94 on the output Q of the flip flop 82 to prevent a fresh dispensing operation whilst the ticket is being printed.

The gate 71 is an authorization gate which allows the control signal emitted by the push button 92 to pass only if all the safety conditions are fulfilled.

The input K of the flip flop 80 receives the end of filling signals which control closure of the electrovalve 43 and printing of a ticket. This input K is connected to the output of the OR gate 79. A first input of the gate 79 is connected to the output of the level sensor 44 which emits an end of filling signal of the recipient. A second input of the gate 79 is connected through the gate 74 on a contact 95 which emits a logic signal 1 when the spout returns to rest position. In the case of the pivoting spout, the contact 95 is a contact of the switch 17. In the case of the sliding spout, the contact 95 is a contact of the switch 58. The second input of the gate 74 is connected to an auxiliary contact of the electrovalve 43 which emits a logic signal 1 when the electrovalve is open.

The closure signal is normally sent on the input K of the flip flop 80 by the level sensor 44. However, if it has not been sent by this sensor when the spout returns into rest position, and if the electrovalve is still open at that moment, it is the contact 95 which then controls the end of a filling cycle, i.e. the closure of the electrovalve and the printing of a ticket.

The two inputs J and K of the flip flop 83 are constantly at level 1 (+5 V), so that the flip flop 83 serves to divide by two the frequency leaving the divider 90 in order to synchronize the print validation signal which is emitted by the gate 76 with the signal for incrementation of the counter 86.

The output Q of the flip flop 81 is permanently at level 1 during the whole printing operation. The output Q of the flip flop 82 is permanently at level during the whole printing operation and this signal, inverted by the inverter 94, inhibits the gate 71 for the whole duration of printing and editing of a ticket.

The returns to zero of the flip flops 80, 81, 82 and 83 are connected in parallel, which enables all the flip flops to be returned to zero at the same time.

The gate 78 has four inputs which are respectively connected to each of the four outputs of the counter 86.

When the output of the counter 86 indicates the binary number 15, all the outputs are at level 1 and the output of the gate 78 passes to level 1. This output, which is connected to the input K of the flip 82, trips the latter and the output Q of the flip flop 82 passing to level 1 opens the gate 83, this indicating the end of printing.

Functioning is as follows:

At the beginning, the inputs J and K of all the flip flops are at level zero, the outputs Q at level 0 and the outputs $\overline{Q}$ at level 1. The gate 77 is blocked and no counting can occur. The electrovalve is closed The gates 72 and 73 are blocked. When a customer presses on the filling button 92, if all the safety contacts $93_1 \ldots 93_n$ are at level 1, the gate 1 allows logic signal 1 to pass. The flip flops 80 and 81 trip and a pulse, of which the duration is equal to the clock period, is emitted by the gate 75 as has already been explained. The output of the gate 75 is connected to the returns to zero of the counters 84 and 96 and the latter are therefore automatically returned to zero by the action of the push button 92 in this example.

As a variant, a diagram may be made in which the return to zero of the counters is controlled by the end of printing.

At the same time, the passage to level 1 of the output Q of the flip flop 81 controls the opening of the electrovalve 43. The dispensing of liquid begins. The sensor 42 emits pulses which pass through the gate 71 which opened at the same time as the electrovalve. The counter 84 counts the pulses emitted by the flow meter.

When one of the two inputs of the OR gate 79 receives a signal at level 1 indicating either the end of filling or the return of the spout into rest position before the electrovalve is closed, the input K of the flip flop 80 passes to level 1, the input J then being at level zero, the flip flops 80 then 81 trip, the outputs Q pass to level zero and the gate 72 emits a square wave pulse whose duration is equal to a clock period.

To passage to level zero of the output Q of the flip flop 81 controls the closure of the electrovalve 43 and blocks the gate 77. The counter 84 no longer receives pulses. The square wave emitted by the gate 72 causes the input J of the flip flop 82 to pass to 1 and the output Q passes to level 1 on the falling front of the clock pulse which follows. This passage to level 1 of the output Q of the flip flop 82 closes the gate 71 preventing the beginning of a new cycle. It deblocks the gate 73 which allows passage of the pulses emitted by the output Q of the flip flop 83 at the frequency of 10 Hz. At the same time, the passage to level 1 of the output Q of the flip flop 82 controls the actuation of the small fan 71.

The output of the gate 73 is connected to the validation input of the buffer 87.

The sixteen pulses emitted by the gate 73 cause the outputs of the counter 86 to advance by 15 steps corresponding to the 16 octets of a message.

Each pulse validates the buffer 87 and transfers therein, one after the other, the 16 octets composing the message whose address has been selected by the counter 84.

The output of the gate 76 delivers a signal synchronous of the one delivered by the gate 73, but of duration twice as short and this signal serves as validation signal of the printer 88, i.e. it controls the printing of the octet which has just been transferred into the buffer (so-called "strobe" signal).

When all the outputs of the counter 86 are at level 1, i.e. when 16 octets have been transferred into the buffer and printed, the output of the gate 78 passes to level 1, which trips the flip flop 82.

Printing is terminated. The gate 71 is open, and the apparatus is ready to carry out a new order for filling controlled by the push button 92.

The diagram of FIG. 9 corresponds to an embodiment in which the closure of the electrovalve 43 and the printing of a message are simultaneously controlled by a signal emitted by the OR gate 79 which comes either from the level sensor 44 or from the rest position contact 95 of the spout.

As a variant, the closure of the electrovalve may be dissociated from the control of the printer. For example, the closure of the electrovalve may be controlled by the level sensor or by a safety contact, for example by a contact of the switch 17 in the case of a pivoting spout or by the contact 62 in the case of the sliding spout, and printing may be controlled in all cases by the return of the spout into rest position, i.e. by a contact of the switch 17 or by the switch 58.

What is claimed is:

1. A dispenser for automatically dispensing into take-away receptacles of variable dimensions, a very accurate volume of liquid which is stored in bulk in at least one tank, said dispenser including a cabinet having at least one dispensing unit, each dispensing unit comprising, in combination:

a mobile spout having means for automatically-returning the spout towards a rest position, and a microswitch actuated by said spout when the latter is in said rest position;

a volume measuring container;

two electrovalves between which said volume measuring container is placed: a filling electrovalve connecting said volume measuring container to said tank, and an emptying electrovalve connecting said tank to said spout;

a switch which opens said emptying electrovalve when it is manoeuvered by a customer;

and means for supplying a ticket indicating the volume and/or the price of the liquid dispensed.

2. A dispenser according to claim 1, including a pipe connecting each emptying valve to a spout, each pipe comprising an air intake located immediately downstream of said emptying valve to allow rapid flow of the liquid contained between said emptying valve and spout.

3. A dispenser according to claim 1, wherein each spout is a rigid tube having an end and being articulated about a horizontal axis and comprises means for automatically returning the tube to a lower position where the end of said spout is lower than an upper end of the smallest receptacle, and a contact of said microswitch being placed in an electrical circuit connecting said switch to said emptying electrovalve and preventing opening of said emptying electrovalve if said spout has not been raised.

4. A dispenser according to claim 1, wherein the spout is a vertical tube which slides in a vertical guiding means, which comprises a means for automatically returning the spout towards a high rest position where the end of said spout is located at a height above the height of the largest receptacle, a handle which enables said spout to be engaged in a receptacle and maintained therein, and a microswitch having a contact open when said spout is in said high rest position, which contact is placed in a circuit for controlling opening of said emptying valve and prevents opening thereof as long as said spout is in said high rest position.

5. A dispenser according to claim 4, wherein the lower end of said spout carries a ring which slides outside said spout when its abuts against an upper edge of a receptacle, in which said spout is engaged, and further comprises a microswitch which is actuated by said sliding ring and which allows opening of said emptying valve when the spout is engaged in the receptacle and which controls closure as soon as said spout leaves said receptacle.

6. A dispenser according to claim 1, wherein each dispensing unit comprises a sink element which is located beneath said mobile spout and which comprises, for supporting said take-away receptacles, support means deformable by the weight of the receptacle, and each unit comprises a microswitch which cooperates with said support means and which has a contact open when said support means is in higher position and said contact is placed in an electrical circuit connecting said switch to said emptying electrovalve.

7. A dispenser according to claim 1, wherein each dispensing unit comprises at least one emitter-receiver couple placed on either side of the normal position of a receptacle beneath said spout, said receiver comprising a contact which is actuated when a beam coming from the emitter is interrupted by a receptacle and which prevents opening of said emptying valve as long as a receptacle is in an incorrect position beneath said spout.

8. A dispenser according to claim 1, wherein said switch is a push button which emits a pulse for every pressing action and said dispenser comprises a pulse counter which records the number of pulses, a memory which contains a plurality of messages each indicating the volume and/or the price of a whole number of doses, each dose corresponding to the volume of said volume measuring container, and a printer which prints the message recorded at an address determined by said pulse counter which serves as address counter of said memory.

9. A dispenser according to claim 1, comprising a programming push button, an upcounter-down counter which records the number of presses of said push-button, a second pushbutton which validates said number of presses and which controls the beginning of dispensing, a timer which emits a number of pulses corresponding to said number of presses at a frequency compatible with the duration of emptying and filling of said volume measuring container, a memory in which a plurality of messages are recorded, each message indicating the volume and/or the price of a whole number of doses, an address counter of said memory and a printer and the rising fronts of the pulses emitted by said timer are recorded by said address counter and each rising front opening said emptying electrovalve and each falling front opening said filling electrovalve.

10. A dispenser according to claim 9, comprising a clock which is connected to the printer through a clock validation AND gate, wherein a contact of said microswitch provokes opening of said gate when said spout returns to rest position after a dispensing cycle, which provokes edition of a ticket totalling the quantity of liquid and/or the total price of the whole number of doses delivered during said cycle.

11. A dispenser for automatically dispensing into takeaway receptacles of variable dimensions a very accurate volume of liquid which is stored in bulk in at least one tank, said dispenser including a cabinet having at least one dispensing unit, each unit comprising:

a mobile spout which is connected to said tank via an electrovalve and which comprises means for automatically returning said spout towards a rest position, and a microswitch actuated by said spout when the latter is in said rest position;

a flow meter which is placed upstream of said electrovalve;

a level sensor which is placed near an end of said mobile spout and which automatically controls closure of said electrovalve when it detects the presence of liquid;

a switch which controls opening of said electrovalve when it is manoeuvered by a customer, and means for supplying a ticket indicating the volume and/or the price of the volume of liquid dispensed.

12. A dispenser according to claim 11, wherein each spout bears a small tube having a lower open end and close to the open end of said spout, said small tube containing said level sensor which is constituted of at least one electrode.

13. A dispenser according to claim 12, wherein said small tube has an upper end connected to a back flow of a small fan which is automatically switched on at the end of each dispensing cycle.

14. A dispenser according to claim 11, wherein said flow meter emits pulses each corresponding to a small unitary volume of liquid having crossed said flow meter, said dispenser comprising a memory in which messages indicating the volume and/or the price corresponding to multiples of said unitary volume are recorded, and a counter acting as address counter of said memory and recording said pulses, and said level sensor automatically controlling simultaneously closure of said electrovalve and printing of a ticket containing the message recorded in the memory at the address recorded by said address counter, and a contact of said microswitch controlling the closure of said electrovalve and printing of a ticket containing said message when said spout returns to said rest position if these operations have not been controlled by said level sensor.

* * * * *